United States Patent [19]

Morimoto et al.

[11] Patent Number: 4,459,514

[45] Date of Patent: Jul. 10, 1984

[54] FLUORESCENT DISPLAY DEVICE

[75] Inventors: Kiyoshi Morimoto; Hiroshi Watanabe, both of Mobara, Japan

[73] Assignee: Futaba Denshi Kogyo Kabushiki Kaisha, Mobara, Japan

[21] Appl. No.: 361,377

[22] Filed: Mar. 24, 1982

[30] Foreign Application Priority Data

Apr. 3, 1981 [JP] Japan ..... 56-49027[U]

[51] Int. Cl.[3] ..... H05B 37/00; G09F 9/00

[52] U.S. Cl. ..... 315/169.1; 315/169.3; 340/781

[58] Field of Search ..... 315/169.1, 169.2, 169.3, 315/169.4; 340/772, 781; 250/486, 483

[56] References Cited

U.S. PATENT DOCUMENTS 2,925,530 2/1960 Engelbart ..... 315/169.2

3,432,724 3/1969 Frost ..... 340/781

3,890,609 6/1975 Sasaki et al. ..... 340/781

4,149,147 4/1979 Kishino ..... 315/169.3

*Primary Examiner*—Harold Dixon

*Attorney, Agent, or Firm*—Oblon, Fisher, Spivak, McClelland & Maier

[57] ABSTRACT

A fluorescent display device capable of preventing display defects and producing a uniform display of a high density wherein a plurality of control electrodes are arranged parallel to one another above a row of anodes each coated with a phosphor layer in the direction perpendicular to the anodes so that each area of the anodes controlled by the respective adjacent two control electrodes forms one of display elements, and a control voltage is simultaneously applied to each adjacent control electrode to allow selected display elements to emit light.

10 Claims, 14 Drawing Figures

FLUORESCENT DISPLAY DEVICE

BACKGROUND OF THE INVENTION

1. Field of the Invention

This invention relates to a fluorescent display apparatus for displaying numerals, characters, graphic forms or the like in a high density matrix form without having any display imperfection.

2. Description of the Prior Art

A fluorescent display apparatus forms a display by impinging electrons emitted from energized filamentary cathodes unto anodes on which is deposited phosphor layers, and to which an anode voltage is selectively applied. The fluorescent display apparatus can be driven at a low voltage for effecting a luminous display of sufficient brightness and is low in power consumption which enables it to be directly driven by a LSI. Furthermore, various luminous colors are obtainable depending upon the phosphor to be used. Because of these advantages inherent in the fluorescent display apparatus, it is widely used as a display device for various electric appliances and the like.

Recently, there has been a demand for a fluorescent display apparatus which is capable of displaying not only numerals or characters but also any optical graphic forms or pictures to be reproduced in a high resolution so as to achieve distinct and intricate displays.

In order to meet such a demand, a dot-matrix type fluorescent display device as shown in FIG. 1 has been proposed and put into practical use in which a plurality of rectangular or circular micro-electrodes arranged on a plane are driven in a matrix fashion. More particularly, the dot-matrix type display device, as shown in FIG. 1, includes a plurality of stripe-like anodes 1 disposed on a substrate (not shown) and phosphor layers 2 coated in the form of rectangle or circle on the anodes 1 so that each of the phosphor layers 2 forms a single display element. Above the phosphor layers 2, a plurality of mesh-like control electrodes 3 are arranged opposite to the phosphor layers 2 so as to extend in the direction perpendicular to the anodes 1. Electrons emitted from a cathode (not shown) impinge on the phosphor layers 2 located at the position where the anodes and the control electrodes respectively having an anode voltage and a control voltage selectively applied thereto cross each other, resulting in the phosphor layers emitting light. A display in the form of letters, figures or the like is accomplished by combining the light emitting phosphor layers as desired.

As stated hereinabove, the conventional dot-matrix type fluorescent display device is generally constructed in the manner that the matrix is composed of the anodes 1 and the control electrodes 3, and the phosphor layers 2 located at the position where the selected anodes and control electrodes cross each other and they are energized by electrons to effect light emission.

In order to improve the density of a display in the dot-matrix type display device, it is required to arrange the phosphor layers 2 with a narrow interval defined therebetween. This results in the control electrodes 3 having to be disposed at narrow intervals. However, such arrangement of the control electrodes results in electrical fields generated from the adjacent control electrodes affecting the path through which electrons impinge on the phosphor layers to cause display defects to occur, thereby deteriorating the quality and clearness of a fluorescent display.

Such display defects are explained with reference to FIG. 2. In FIG. 2, reference numerals 2*a* and 3*a* designate a phosphor layer to emit light of phosphor layers 2 and a control electrode disposed opposite to the phosphor layer 2*a*, respectively. On both sides of the electrode 3*a*, control electrodes 3*b* are disposed adjacent thereto. When an anode voltage and a control voltage are respectively applied to an anode 1 and the control electrode 3*a*, electrons e emitted from a cathode impinge on the phosphor layer 2*a* to allow it to effect light emission. However, the control electrodes 3*b* adjacent to the electrode 3*a* are applied thereto a negative voltage identical with or below the voltage of the cathode to generate negative fields. This results in the path of electrons being curved, so that electrons may not impinge on the periphery of the phosphor layer 2*a* thereby generating display defects.

The less the interval between the control electrode is, the greater the display defects. Such display defects become a serious problem in the case of producing a display of a high density in the dot-matrix type fluorescent display device.

BRIEF SUMMARY OF THE INVENTION

The present invention is intended to eliminate the foregoing disadvantages in the prior art.

Accordingly, it is an object of the present invention to provide a fluorescent display device capable of preventing display defects and producing a uniform display of a high density in which a plurality of anodes, each having a phosphor layer coated on the upper surface thereof, are arranged one after another in the row or column direction of a matrix. A plurality of control electrodes are arranged parallel to one another above the anodes in the direction perpendicular to the anodes so that each area of the anodes controlled by the respective adjacent two control electrodes forms one of display elements, and a control voltage is simultaneously applied to the adjacent two control electrodes.

In accordance with the present invention, there is provided a fluorescent display device comprising a fluorescent display tube section including a substrate made of an insulating material, a plurality of anodes having a phosphor layer coated on the upper surface thereof and disposed one after another on said substrate so as to extend parallel to each other, a plurality of control electrodes spaced from the anodes and arranged one after another in the direction perpendicular to the anodes, a cathode stretched above the control electrodes, each area of the anodes being controlled by the respective adjacent two control electrodes forming one of the display elements. A circuit section for driving the fluorescent display tube section is adapted to simultaneously apply a control voltage to each of the adjacent two control electrodes.

BRIEF DESCRIPTION OF THE DRAWINGS

Other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENTS

Figure 1:
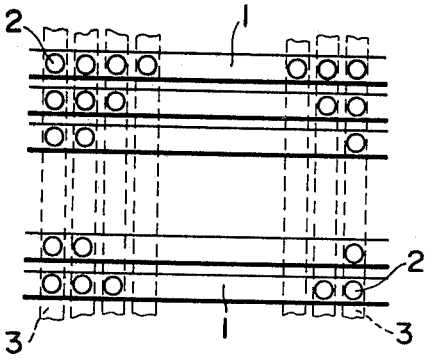
FIG. 1 is a plan view showing a display section of a conventional fluorescent display device.
Figure 2:
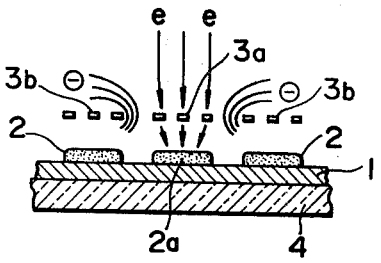
FIG. 2 is a view for explaining display defects occurring in a conventional fluorescent display device.
Figure 3:
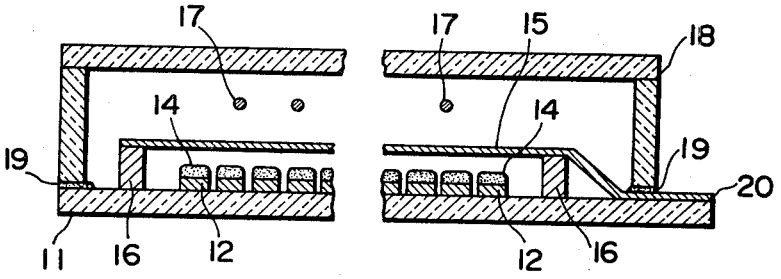
FIG. 3 is a partially cutaway longitudinal sectional view showing an essential part of one embodiment of a fluorescent display device according to the present invention.
Figure 4:
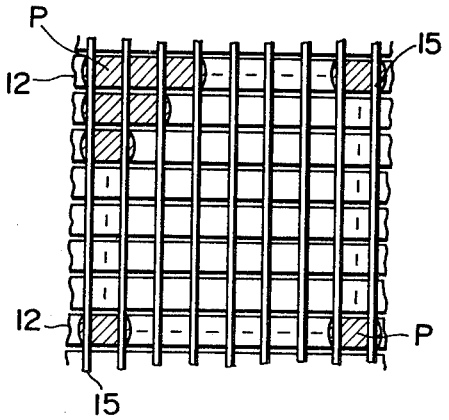
FIG. 4 is a view showing an example of the arrangement of anodes and control electrodes in the embodiment of FIG. 3.

Referring now to the drawing a fluorescent display device according to the present invention will be hereinafter described with reference to the accompanying drawings, and more particularly FIG. 3 is a partially cutaway longitudinal sectional view showing a fluorescent display tube section which is one of the essential parts of one embodiment of a fluorescent display device according to the present invention, and FIG. 4 is a view illustrating the arrangement of anodes and control electrodes. The fluorescent display device includes a substrate 11 made of an insulating material. In a fluorescent display device of the type that a display is observed through the substrate 11, the substrate 11 is preferably made of a transparent insulating material such as glass.

The fluorescent display device also includes a plurality of anodes 12 arranged parallel to one another on the substrate 11 along one direction of the substrate. In a display device of the type where a display is observed through a front cover described hereinafter, the anodes 12 are preferably made of a deposited metal film such as, for example, silver, aluminum or the like. Alternatively, in a display device wherein a light emitted from a phosphor layer is noticed through the substrate 11, it is required to form the anodes 12 of a transparent conductive film. In the latter case, a large-sized display device causes both longitudinal ends of each anode to have different voltages due to voltage drop along the longitudinal direction thereof, resulting in a produced display having a nonuniform luminance because the transparent conductive film has a high resistance as compared with a metal conductor.

Figure 5:
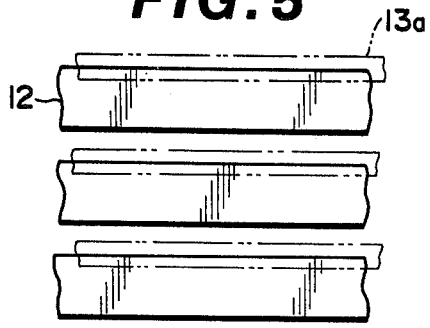
FIGS. 5 and 6 are plan views showing examples of an anode construction in the embodiment of FIG. 3, respectively.
Figure 6:
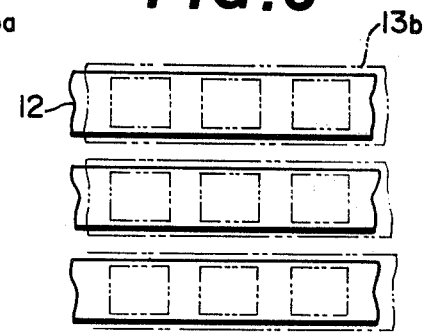

In order to eliminate such disadvantage, it is required in a large-sized display device to employ a means for compensating such voltage drop. One of the essential features of the present invention resides in that auxiliary conductors **13*a* are used as such means. These conductors 13*a* are formed of a high conductive material such as, for example, silver or aluminum into a deposited film and are disposed in contact with the respective anodes in a manner not to interfere with the areas of the anodes on which phosphor layers are to be coated, as shown in FIG. 5. Alternatively, such means, as shown in FIG. 6, may comprise auxiliary conductors 13*b*** applied on the anodes which have blank spaces provided at the portions corresponding to the phosphor layer coated areas of the anodes.

Figure 7:
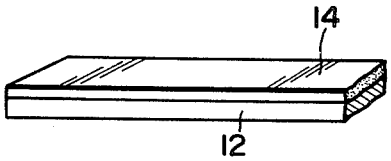
FIGS. 7 and 8 are partially perspective views for illustrating manners of coating anodes with a phosphor layer in the embodiment of FIG. 3, respectively.
Figure 8:
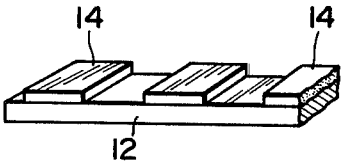

Each of the anodes 12 has a phosphor layer 14 coated thereon. The phosphor layer 14 may be coated in a stripe-like shape to cover the entire upper surface of each anode as shown in FIG. 7, or may be coated in the shape of dots on only the areas of each anode on which display elements are to be formed in such a manner as described hereinafter.

Above the anodes 12, a plurality of control electrode 15 are supported so as to be opposite the anodes by spacers 16, as shown in FIG. 3. The control electrodes are arranged one after another in the direction crossing or perpendicular to the anodes 12. The control electrode 15 may be formed of a metal wire having a diameter of as small as several multiples of ten micrometers. Alternatively, it may be made of a very thin metal film subjected to an etch processing. Display elements in a dot-matrix type display device, as shown in oblique lines in FIG. 4, are formed by areas of the anodes 12 controlled by the respective adjacent two control electrodes 15.

The fluorescent display device further includes at least one filamentary cathode 17 stretched above the control electrodes 15. The above-mentioned electrodes are disposed in a high vacuum envelope made up of the substrate 11 and a front cover 18 hermetically sealed on the periphery of the substrate by a sealing material 19. In the embodiment shown in FIG. 3, the front cover 18 is made up of a plurality of flat members into the shape of an open box. However, it may be formed of a single plate member into the shape of an open box or a tray. In a fluorescent display device of the type that luminescence from the phosphor layers 14 is observed through the front cover 18, the anodes 12 may be made of a non-light-permeable conductive material such as metal, graphite or the like as mentioned above; however, the areas of the cover 18 opposite to the phosphor layers 14 should be formed of a light-permeable material.

The control electrodes 15 have external lead terminals 20 led out through the sealed portion between the substrate 11 and the front cover 18 in an air-tight manner. In a similar manner, the anodes 12 also have lead terminals (not shown) led out through the sealed portion.

In the fluorescent display tube section constructed in the above-mentioned manner, each of the control electrodes 15 is formed in the linear shape to allow the display elements to be arranged with a very narrow interval defined therebetween, resulting in a display of a high density being effected.

A circuit section of the fluorescent display device according to the present invention which is adapted to drive the fluorescent display tube section will now be explained with reference to FIG. 9.

Figure 9:
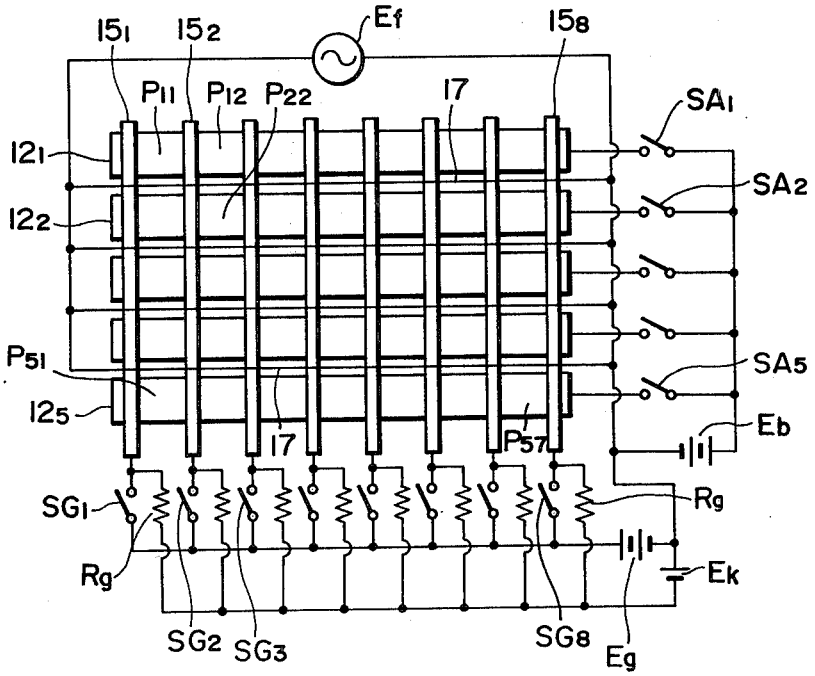
FIGS. 9 and 10 are views for illustrating a manner of driving a fluorescent display tube section in the embodiment of FIG. 3.

In FIG. 9, the numbers of anodes and control electrodes are respectively five and eight for the clarity in the description, wherein the anodes $12_1$–$12_5$ each having a phosphor layer coated thereon are arranged in rows and the control electrodes $15_1$–$15_8$ are arranged in columns in the direction crossing the anodes. In addition, the areas of the anodes 12 controlled by the respective adjacent two control electrodes 15 form display elements $P_{11} \ldots P_{57}$.

The circuit includes switches $SA_1$–$SA_5$ provided with respect to the respective anodes 12 to close in response to display signals and switches $SG_1$–$SG_8$ provided with respect to the respective control electrodes 15 to scan the electrodes 15 in turn. The circuit further includes grid resistors Rg for keeping the voltage of unselected control electrodes 15 below that of the cathodes 17, a heating source Ef for heating the cathodes 17, an anode source Eb for applying an anode voltage to selected anode 12, a control source Eg for applying a control voltage to selected control electrodes 15 and a bias source $E_k$ of keeping the voltage of the unselected control electrodes 15 below the voltage of the cathodes through the grid resistors Rg.

In the circuit of FIG. 9 made up in the above-mentioned mode, the switches $SG_1$–$SG_8$ are adapted to allow the respective adjacent two control electrodes 15 to be simultaneously scanned in turn.

More particularly, supposing that the switches $SG_1$ and $SG_2$ of the respective adjacent two switches $SG_1$ and $SG_2, \ldots, SG_7$ and $SG_8$ are simultaneously closed to scan the adjacent two control electrodes $\mathbf{15}_1$ and $\mathbf{15}_2$, the switch $SG_1$ is firstly closed and the switch $SG_2$ is then closed in a predetermined time to simultaneously apply a control voltage to the control electrodes $\mathbf{15}_1$ and $\mathbf{15}_2$ within a period $T_1$.

Figure 10:
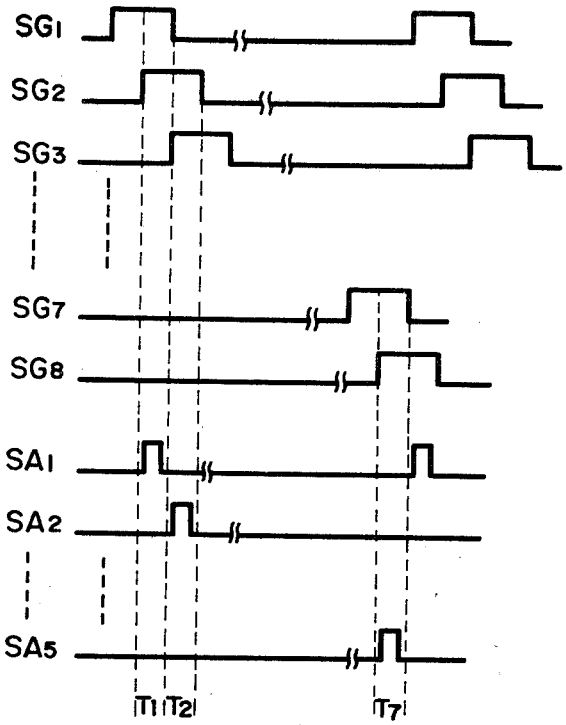
Figure 11:
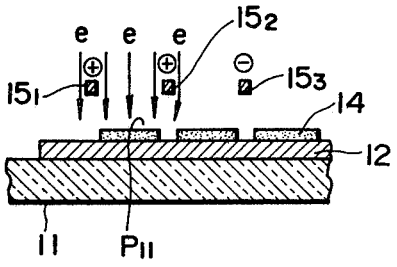
FIGS. 11 and 12 are views for illustrating manners in which electrons impinge a phosphor layer, in the embodiment of FIG. 3, respectively.
Figure 12:
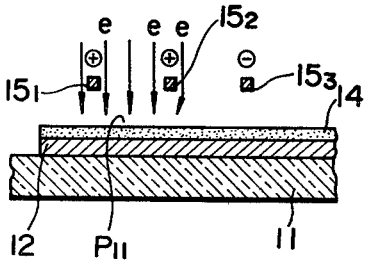

During the period $T_1$, display elements P11, P21, P31, P41, P51 in a first row are selected, and one of the display elements emits light which is on the anode 12 selected by one of the switches $SA_1$–$SA_5$ closed in response to a predetermined display signal during the period $T_1$. For example, when the switch $SA_1$ is closed within the period $T_1$ as shown in FIG. 10 to apply an anode voltage to the selected anode $\mathbf{12}_1$, electrons emitted from the cathodes 17 impinge on the display element $P_{11}$ to energize the phosphor layer of the display element $P_{11}$, to thereby allow it to effect light emission. More particularly, as shown in FIG. 11, the control electrodes $\mathbf{15}_1$ and $\mathbf{15}_2$ positioned above the phosphor layer forming the display element $P_{11}$ so as to put it therebetween are kept at a positive potential, therefore, a positive electrical field is produced above the display element $P_{11}$ to permit electrons e emitted from the cathode 17 to impinge on the entire surface of the display element $P_{11}$ without deflecting, thereby preventing display defects and producing a uniform display of a high quality.

In such case, when the phosphor layer, as shown in FIG. 7, is coated on the entire surface of the anode rather than in the form of dots, electrons impinge on a part of display elements adjacent to the display element $P_{11}$ as well to cause the part to emit light. However, such light emission allows display elements emitting light to be successively observed, resulting in a good display in the form of characters or continuous figures being produced.

Subsequently, when the switch $SG_3$ is closed simultaneously with or in a suitable blanking time after the open of the switch $SG_1$ in FIG. 10, the switches $SG_2$ and $SG_3$ are closed with a period $T_2$ to apply a control voltage to the control electrodes $\mathbf{15}_2$ and $\mathbf{15}_3$. Thus, during the period $T_2$, the display elements $P_{12}$–$P_{52}$ in a second row are selected; and, for example, as shown in FIG. 10, when the switch $SA_2$ is closed during the period $T_2$ to apply an anode voltage to the anode $\mathbf{12}_2$, the display element $P_{22}$ emits light.

Thus, the respective adjacent two control electrodes 15 are simultaneously scanned in turn and an anode voltage is applied to each selected anode 12 in response to a display signal synchronously with the scanning, so that a dense display without any display defects in the form of letter, figures or the like may be produced.

Figure 13:
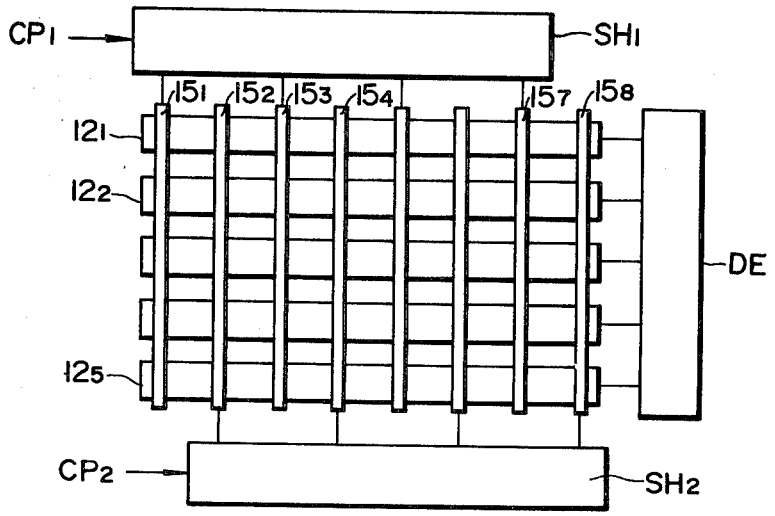
FIG. 13 is a view showing an example of a driving circuit in the embodiment of FIG. 3.

An operation for scanning the control electrodes in turn and supplying the anodes 12 with display signals is effected in such a manner, for example, as shown in FIG. 13.

The control electrodes $\mathbf{15}_1$, $\mathbf{15}_3$, $\mathbf{15}_5$ and $\mathbf{15}_7$ arranged at the odd-numbered positions are connected to a first shift register $SH_1$, and the control electrodes $\mathbf{15}_2$, $\mathbf{15}_4$, $\mathbf{15}_6$ and $\mathbf{15}_8$ at the even-numbered positions are connected to a second shift register $SH_2$. When the shift registers are shifted in turn by clock pulses $CP_1$ and $CP_2$ having a phase difference of 180° therebetween to scan the control electrodes 15, the respective adjacent two control electrodes may be simultaneously scanned in turn at time intervals as shown in FIG. 10. And, display signals decorded by a decorder circuit DE are applied to the selected anodes synchronously with the scanning of the control electrodes 15, so that a desired display may be produced.

The illustrated embodiment, as explained hereinabove, is adapted to supply the anodes with display signals and scan the control electrodes 15. However, it is of course that the present invention may be constructed to scan the anodes 12 and apply the display signals to the control electrodes.

In addition, in the illustrated embodiment, the control electrodes 15 are disposed above the anodes 12 so as to oppose to the anodes by means of the spacers 16. However, the control electrodes can be disposed on insulating supporters as shown in FIG. 14.

Figure 14:
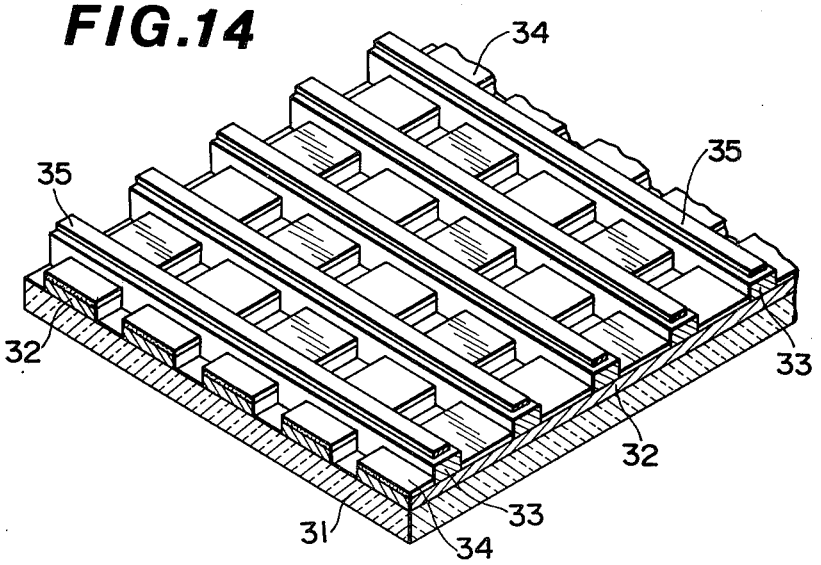
FIG. 14 is an enlarged perspective view showing an essential part of another embodiment of a fluorescent display device according to the present invention.

FIG. 14 is an enlarged perspective view showing a part of a display section in another embodiment of a fluorescent display device according to the present invention. The embodiment of FIG. 14 includes a substrate 31, a plurality of anodes 32 arranged parallel to one another on the substrate along one direction of the substrate, and a plurality of bar-shaped insulating supporters 33 arranged one after another in the direction perpendicular to the anodes 32. The insulating supporters 33 may be formed utilizing a screen printing process. Alternatively, the supporters may be formed by applying an insulating layer on the entire surface of the substrate 31 including the surfaces of the anodes 32 and then etching the insulating layer to remove the needless portions. The fluorescent display device further includes control electrodes 35 which are formed by applying a conductive material on the insulating supporters 33 utilizing a screen printing or depositing process. In addition, the embodiment includes phosphor layers 34 coated on the exposed portions of the anodes 32 by, for example, a depositing process, so that the areas of the anodes 32 sandwiched between the respective adjacent two insulating supporters 33 form display elements. In the illustrated embodiment, the insulating supporters 33 and control electrodes 35 may be simultaneously formed by firstly forming an insulating layer on the upper surface of the substrate 31 having the anodes formed thereon, then applying a deposited metal film such as aluminum on the insulating layer, and finally subjecting simultaneously the insulating layer and deposited film to an etch processing to remove the needless portions of the both.

The embodiment shown in FIG. 14 has an advantage of facilitating formation of the control electrodes 15 and ensuring the relating of the control electrodes because the control electrodes are formed on the insulating supporters 33.

The embodiments illustrated in FIGS. 3 and 14 may be constructed in such a manner that the display elements are divided into plural groups and electrically independent additional control electrodes are arranged between the control electrodes 15 or 35 and the cathodes so as to correspond to the respective groups of display elements, to thereby effect a multi-digit display.

As stated hereinabove, the fluorescent display device according to the present invention includes the fluorescent display tube section comprising the substrate made of an insulating material, the anodes disposed one after another on the upper surface of the substrate along one direction of the substrate and each having the phosphor layer coated on the upper surface thereof, the control electrodes of a conductive material arranged above the anodes in the direction perpendicular to the anodes so that the areas of the anodes controlled by the respective adjacent two control electrodes form display elements, whereby selected display elements may emit light to produce a desired display by simultaneously applying a control voltage to the adjacent control electrodes.

Thus, in the fluorescent display device according to the present invention, it is possible to form each control electrode of a wire-like material having a micro diameter or a micro width; this resulting in the display elements being arranged one after another with a very narrow interval defined therebetween, to thereby produce a display of a high density. In addition, a display signal is simultaneously applied to the adjacent control electrodes located above the display element to emit light so as to put it therebetween, to thereby prevent the path of electrons impinging the phosphor layer from being affected by the fields of unselected control electrodes; thus, it is possible to prevent display defects and to produce a uniform display of a high quality in the form of letters, figures or the like.

Furthermore, in the fluorescent display device of the present invention, there is not provided, above the front of each display element, any electrode interfering with the observation of a display. This allows the luminescence of the display elements to be clearly observed in a display device of the type of observing a display through a cathode. Also, this results in a clear display of high quality and density being produced in a display device wherein a display is observed through a substrate, because the present invention is adapted to reduce the light which reflects the surfaces of the internal electrodes to transmit through the substrate.

Obviously, many modifications and variations of the present invention are possible in the light of the above teachings. It is therefore to be understood that, within the scope of the appended claims, the invention may be practiced otherwise than as specifically described.

What is claimed as new and desired to be secured by Letters Patent of the United States is:

1. A fluorescent display device comprising:

a fluorescent display tube section including a substrate made of an insulating material, a plurality of longitudinally extending anodes each coated with a phosphor layer on the upper surface thereof and disposed parallel to one another on said substrate, a plurality of longitudinally extending control electrodes spaced apart at predetermined intervals above said anodes, said control electrodes arranged in a direction perpendicular to said anodes, wherein said control electrodes and said anodes coated with said phosphor layer define plural display elements, each display element including a portion of said phosphor coated anode located beneath and between adjacent of said control electrodes, at least one cathode stretched above said control electrodes for providing a source of electrons; and a circuit section for driving each of said display elements, including means for simultaneously supplying a first control voltage to said two adjacent control electrodes for directing said electrons to impinge on said phosphor layer, and means for supplying to the control electrodes of all remaining said control electrodes of said display element a second control voltage with a polarity opposite that of said first control voltage for deflecting said electrons from said phosphor layer.

2. A fluorescent display device as defined in claim 1, wherein said substrate is made of a transparent material.

3. A fluorescent display device as defined in claim 1 or 2, wherein said anodes are made of a deposited metal film.

4. A fluorescent display device as defined in claim 1 or 2, wherein said anodes are made of transparent conductive film.

5. A fluorescent display device as defined in claim 1 or 2, wherein said anodes are made of a transparent conductive film and a high conductive material extending in contact with said conductive film to reduce a resistance of said anodes.

6. A fluorescent display device as defined in claim 1 or 2, wherein said phosphor layer is coated in the shape of a stripe on the upper surface of each of said anodes.

7. A fluorescent display device as defined in claim 1 or 2, wherein said phosphor layer is intermittently coated in the form of dots on the upper surface of each of said anode.

8. A fluorescent display device as defined in claim 1 or 2, wherein each of said control electrodes is made of a wire-like conductor.

9. A fluorescent display device as defined in claim 1 or 2, wherein said control electrodes are disposed on insulating supporters.

10. A fluorescent display device as defined in claim 1 or 2, wherein said circuit section is adapted to simultaneously supply said first voltage to each adjacent two control electrodes and supply said first voltage to the respective adjacent two control electrodes in turn.

* * * * *